United States Patent [19]

Foglia

[11] 4,158,517

[45] Jun. 19, 1979

[54] OSCILLATING STRUCTURE FOR EXPLORATION AT SEA

[75] Inventor: Vincent F. P. Foglia, Aulnay-sous-Bois, France

[73] Assignee: Compagnie Generale pour les Developpements Operationnels des Richesses Sous-Marines, Paris, France

[21] Appl. No.: 891,325

[22] Filed: Mar. 29, 1978

[30] Foreign Application Priority Data

Apr. 8, 1977 [FR] France ..... 77 10791

[51] Int. Cl.[2] ..... E02B 17/00

[52] U.S. Cl. ..... 405/202; 9/8 P; 64/17 R

[58] Field of Search ..... 61/95, 17 R, 17 A; 9/8 P; 405/202

[56] References Cited

U.S. PATENT DOCUMENTS

| | | | |
|---|---|---|---|
| 2,271,523 | 2/1942 | Dunn et al. | 64/17 A |
| 3,693,362 | 9/1972 | Leonard et al. | 61/95 |
| 3,766,582 | 10/1973 | Lloyd et al. | 61/95 |
| 4,026,119 | 5/1977 | Dotti | 61/95 |
| 4,058,137 | 11/1977 | St. Palais et al. | 61/95 X |

*Primary Examiner*—Jacob Shapiro

*Attorney, Agent, or Firm*—Wigman & Cohen

[57] ABSTRACT

An oscillating structure for exploration at sea features a column which rests on a heavy base resting on the sea bottom, and which supports a platform above sea level. The column is connected to the base by an articulated joint which allows it to oscillate in all directions under action of swell, the articulated joint comprising two base plates cooperating with the substantially flat and parallel surfaces of the bottom of the column and the upper surface of the base respectively, two supports fixed on each of the plates and parallel one to the other, bearings, formed of two half bearings which can be dismantled, fixed to the ends of the said supports, the bearings of the supports fixed to the same base plate being in alignment, and a cross shaped member, whose branches are located in different planes, extending between the bearings.

3 Claims, 7 Drawing Figures

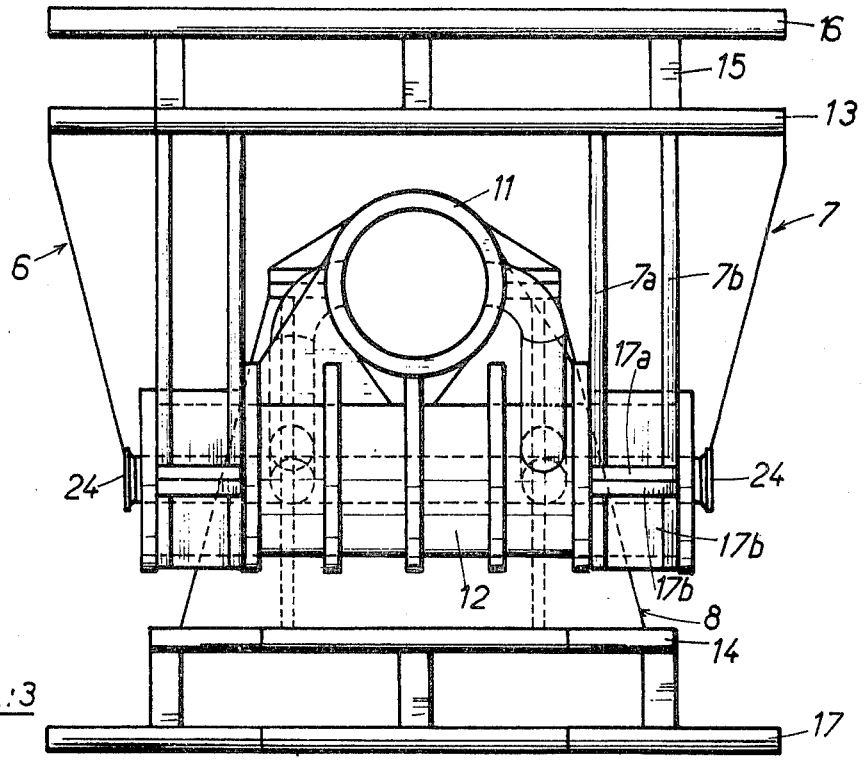
FIG.: 3
FIG.: 4
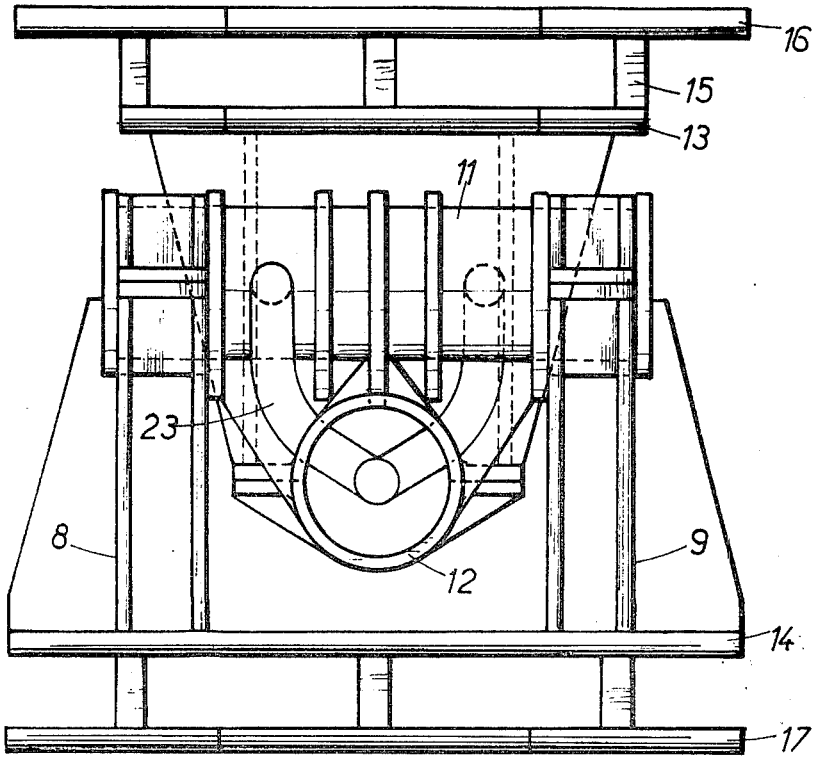

OSCILLATING STRUCTURE FOR EXPLORATION AT SEA

The invention relates to an oscillating structure for exploration at sea, the said structure being installed on site and featuring a column which rests on a heavy base resting on the sea bottom and which supports a platform above sea level, the said column being connected to the base by an articulated joint which allows it to oscillate in all directions under the action of swell.

Oscillating structures are known in which the column is connected to the base by a swivel. According to the type of construction, the column may be subjected to a negative or positive thrust which means that the articulation is permanently operating in traction or compression. The members constituting the swivel are in part carried by the bottom of the column and in part by the surface of the base. Given the type of articulation, the column and the base should be specially shaped to receive the cooperating parts of the swivel. Thus in the case where the column receives a spherically convex part serving as the ball of a ball-and-socket coupling, it is necessary, for large scale members, to provide a bottom to the column featuring substantially the same shape as the piece it receives in order to ensure an effective support. The same applies to the base.

The manufacture of concrete elements to which the swivel parts are to fit is relatively a delicate business and the connecting of the parts is no less delicate.

The invention is directed to the production of an oscillating structure in which the end of the column and the base receiving the articulation do not require any special shape other than that of two essentially flat surfaces at right-angles to the central axis of the structure when it is on site in a vertical position. The joint is of the universal type and works under compression.

This articulated joint features four bearing supports, fixed and aligned two by two on each of the elements of the structure, i.e. the bottom of the column and the upper surface of the base. These bearings cooperate with a cross-shaped member the branches of which are in different planes. The branch cooperating with the bearings, the supports of which are attached to the bottom of the column, is, according to a preferred embodiment, arranged below the branch cooperating with the bearings whose supports are attached to the base.

Figure 1:
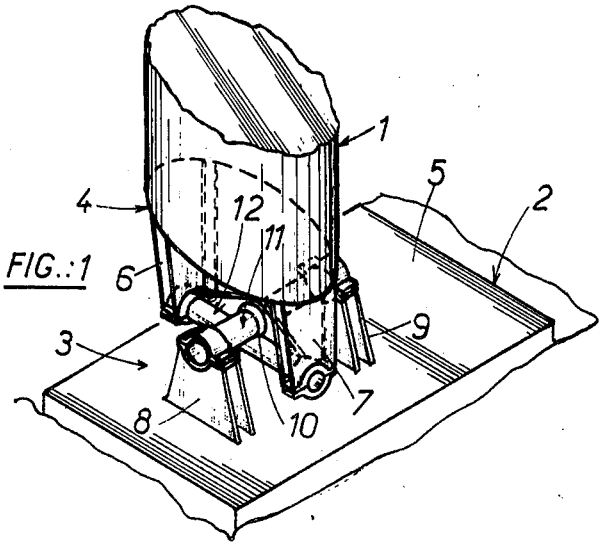
Figure 2:
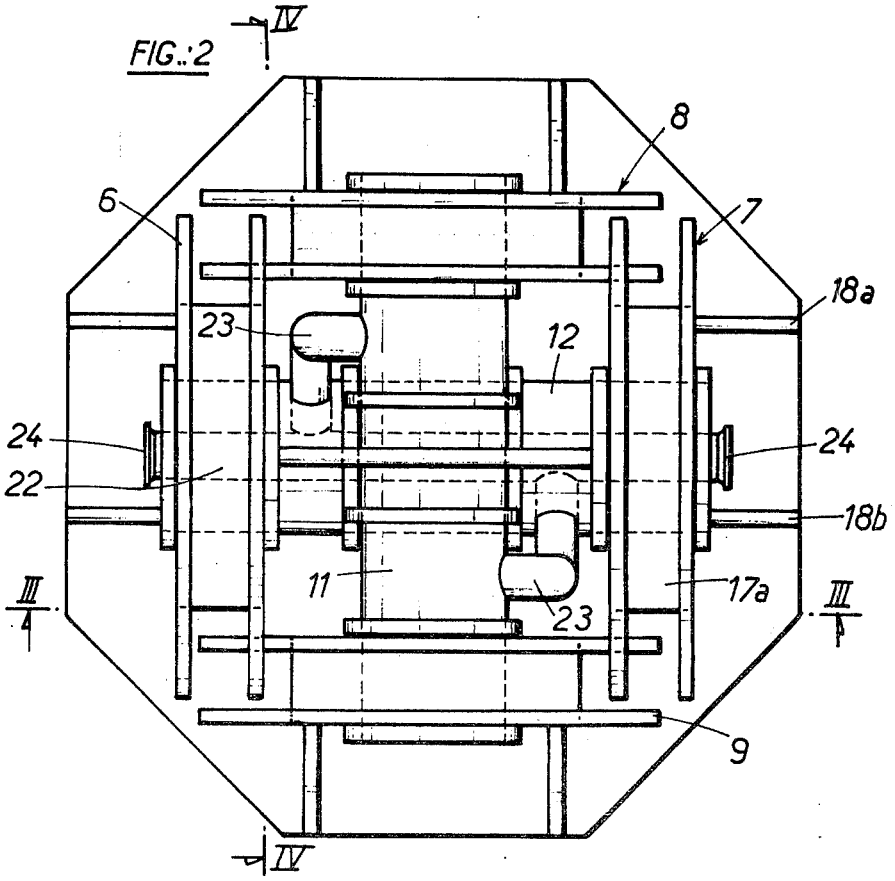
Figure 7:
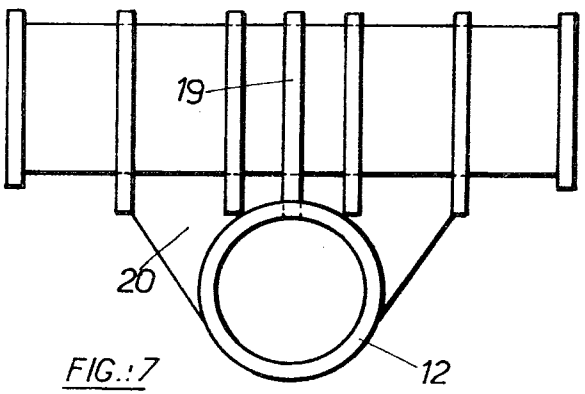
Figure 6:
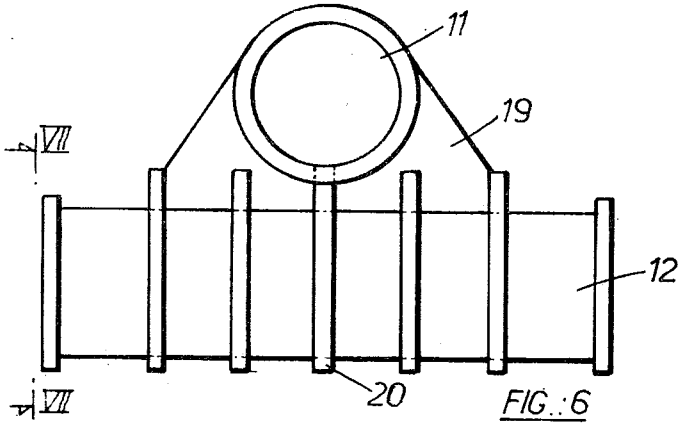
Figure 5:
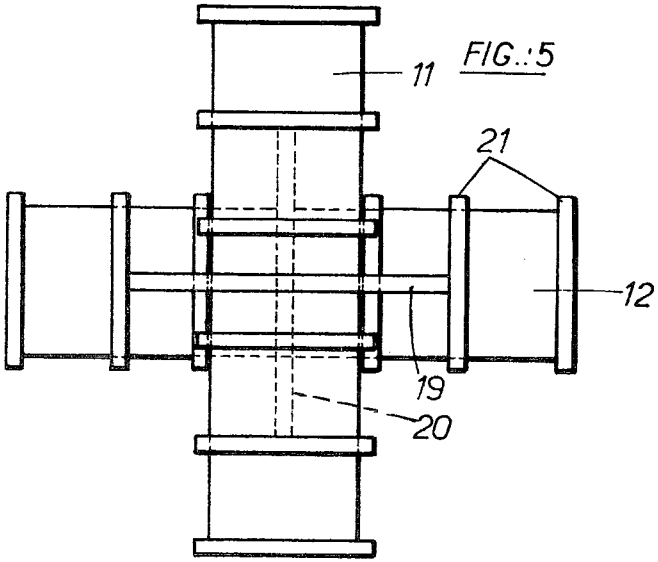

The following description, by way of example, will allow the construction of the invention to be well understood, reference being made to the accompanying drawings, in which:

FIG. 1 is a schematic view in perspective of the base of a structure according to the invention, FIG. 2 is a plan view of the articulated joint, the upper support plate for the bearings being removed, FIG. 3 is a sectional view along the line III—III of FIG. 2, FIG. 4 is a sectional view along the line IV—IV of FIG. 2, FIG. 5 is a plan view of the cross-shaped member, FIG. 6 is an elevation of the cross-shaped member, and FIG. 7 is a view along the line VII—VII of FIG. 6.

FIG. 1 shows a schematic view of a part of a structure according to the invention. A column 1 is connected to a base 2 by a universal joint 3. As shown in the drawing, the bottom 4 of the shaft is flat and parallel to the upper surface 5 of the base 2. When the structure is in place on site, and is not subjected to the action of swell, the column 1 is substantially perpendicular to the surface of the sea bottom, the bottom 4 of the column and the surface 5 of the base are then substantially parallel and at right angles to the central axis of the column.

The column is subjected to ballast near to its lower end in such a manner that the total weight of the ballast and the column/base assembly is greater than the maximum upward force which would be exerted on the column by the strongest swells, and thus the articulated joint is permanently under compression.

As shown on this schematic drawing, the universal joint features four supports 6, 7, 8 and 9 arranged two by two 6, 7 and 8, 9, mounted on the bottom 4 of the column 1 and on the surface 5 of the base 2, respectively. These supports carry bearings in which the ends of the branches of the cross-shaped member 10 are placed.

According to the embodiment shown, the cross-shaped member 10 is made up of two branches 11 and 12, one of which, 11, rests in the bearings of the supports 8 and 9 mounted on the base and the other, 12, in the bearings of the supports 6 and 7 mounted on the bottom of the column. The branch 12 is in a different plane to that of the branch 11 and below it, so as to ensure a better stability with the cross-shaped member assembly.

The cross-shaped member can equally be made up of two branches in the same plane, as is more usually the case.

FIGS. 2, 3, 4, show an embodiment with a universal joint particularly suitable for a structure in which the column permanently bears down on the base, the articulated joint being subjected to a continuous compression.

The supports 6, 7 and 8, 9 are fixed to base plates 13 and 14 respectively. These plates are themselves connected by struts 15 to substantially hexagonal plates 16 and 17 respectively which are themselves mounted on the bottom 4 of the column and on the upper surface 5 of the base respectively by means known per se, such as threaded bolts partly sunk in the concrete when the elements were made. The supports each comprise two plates (e.g. *7a, 7b*) spaced one from the other, holding at their ends a bearing 17 consisting of two half-collars *17a, 17b*. The support plates are stiffened by buttresses *18a, 18b*. The supports are arranged two by two in parallel planes so that the axes of the bearings on opposing supports are in alignment.

The above detailed description of a support and its bearings applies equally to other supports and bearings which are all similar.

The bearings, which can be dismantled, are made up of two half bearings to permit the insertion of the extensions of the cross-shaped members formed by the ends of the branches 11 and 12.

FIGS. 5, 6, 7 show a cross-shaped member the axes of whose branches 11 and 12 are in different parellel planes. The branches of the cross-shaped member are, in the exmaple of the embodiment, made up of tubular sections 1 meter in diameter, the axes of the branches being separated by 1.30 m. The connection between the branches is made by strut plates 19 and 20 according to known welding processes.

In order to avoid displacement of the cross-shaped member during oscillation of the structure, lateral displacement in the bearings is restricted by rings 21, which, according to the embodiment adopted, can be clamped-on or welded-on rings.

In FIGS. 2, 3 and 4, there is shown a system of pipes extending axially of the branches and connections 23 connecting, for example, the upper branch 11 to the lower branch 12. The pipes 22 located in the lower branch feature connecting flanges 24 on their ends and similar pipes located in the upper branch and not shown feature similar connecting flanges. The system constituted by this assembly allows the connection, for example, of a pipe emerging on a bridge supported by the column 1 to an under-water pipe. The connections are made by swivel joints, or the like.

The same pipe system can, with minor modifications, (consisting of providing lubrication pipes in the extensions of the arms), be used as a lubricating device for the cross-shaped member. It is clear that in this case, only the flanges 24 of one of the branches will be used to feed the lubricant.

I claim:

1. An oscillating structure for exploration at sea, said structure being installed on site and comprising:

a base resting on the sea bottom, a column resting on the base and supporting a platform above sea level, an articulated joint connecting the column to the base and allowing the column to oscillate in all directions under action of swell, said column being ballasted in such a manner that the total weight of the ballast and the column/base assembly is greater than the maximum upward force which would be exerted on the column in order to maintain the articulated joint under permanent compression, said articulated joint having two base plates fixed respectively at the bottom of the column and at the upper surface of the base, two fixed supports mounted on each of the base plates and parallel one to the other, bearings, formed of two half collars which can be dismantled, fixed to the end of said fixed supports, the axes of the bearings being in alignment, a cross-shaped member formed by two perpendicular branches located in different planes, and extensions of the cross-shaped member oscillating in said bearings.

2. An oscillating structure according to claim 1, wherein upper branches of the cross-shaped member cooperate with the fixed supports mounted on the base by way of one of the two base plates, and lower branches of the cross-shaped member cooperate with the fixed supports mounted on the column by way of the other of the two base plates.

3. An oscillating structure according to claim 1, further comprising:

a pipe parallel to the axis of each of the branches of the cross-shaped member and connected with at least one of its ends to a flange coaxial with each of the branches, said flange being attached to the end of the extensions, and conduits connecting the pipe of one of the branches to that of the other, said pipes and conduits permitting connection between a pipeline carried by the column with an underwater pipeline.

* * * * *